US010502469B2

(12) United States Patent
Ku et al.

(10) Patent No.: US 10,502,469 B2
(45) Date of Patent: Dec. 10, 2019

(54) ACCUMULATOR

(71) Applicant: LG ELECTRONICS INC., Seoul (KR)

(72) Inventors: Sejin Ku, Seoul (KR); Hyungjin Park, Seoul (KR); Sangmyung Byun, Seoul (KR); Gyeongsu Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 123 days.

(21) Appl. No.: 15/709,211

(22) Filed: Sep. 19, 2017

(65) Prior Publication Data

US 2018/0306475 A1 Oct. 25, 2018

(30) Foreign Application Priority Data

Apr. 21, 2017 (KR) ..... 10-2017-0051668

(51) Int. Cl.
*F25B 43/00* (2006.01)

(52) U.S. Cl.
CPC ..... *F25B 43/006* (2013.01); *F25B 2500/12* (2013.01); *F25B 2500/13* (2013.01)

(58) Field of Classification Search
CPC ..... F25B 43/006; F25B 2500/13
See application file for complete search history.

(56) References Cited

U.S. PATENT DOCUMENTS 4,187,695 A * 2/1980 Schumacher ..... F25B 41/00 62/116
5,233,840 A * 8/1993 Scaringe ..... F25D 3/00 165/46
5,996,372 A * 12/1999 Koda ..... F25B 43/006 62/471
6,708,519 B1 * 3/2004 Monk ..... F25B 43/006 62/498

FOREIGN PATENT DOCUMENTS

EP 0 887 603 A2 12/1998
EP 2 896 914 A1 7/2015
KR 10-2012-0082803 A 7/2012

* cited by examiner

*Primary Examiner* — Melvin Jones
(74) *Attorney, Agent, or Firm* — Dentons US LLP

(57) ABSTRACT

An accumulator having a case which forms a space in which liquid refrigerant and gaseous refrigerant are accommodated, a suction pipe connected to a first side of the case, a connection pipe that connects a second side of the case to a suction side of the compressor, and a gas-liquid separation pipe disposed inside the case to guide the gaseous refrigerant to the connection pipe, and in which the gas-liquid separation pipe is disposed inside the case and is separated from the connection pipe.

20 Claims, 8 Drawing Sheets

ACCUMULATOR

CROSS-REFERENCE TO RELATED APPLICATIONS

The present application claims priority under 35 U.S.C. 119 and 35 U.S.C. 365 to Korean Patent Application No. 10-2017-0051668, filed on Apr. 21, 2017, which is hereby incorporated by reference in its entirety.

BACKGROUND

The present invention relates to an accumulator which is connected to a compressor.

In general, a compressor is a mechanical device that receives power from a power generating device such as an electric motor and a turbine and compresses air, refrigerant or various other working gasses to increase the pressure thereof. The compressor is widely used throughout a household appliance such as a refrigerator and an air conditioner or the industry.

These compressors may be broadly divided into a reciprocating compressor, a rotary compressor, and a scroll compressor.

The reciprocating compressor may be a compressor that compresses the refrigerant while a piston linearly reciprocates in a cylinder so as to form a compression space in which a working gas is sucked and discharged between the piston and the cylinder.

In addition, the rotary compressor may be a compressor in which a compression space in which a working gas is sucked and discharged is formed between a roller which is eccentrically rotated and a cylinder and the roller is eccentrically rotated along an inner wall of the cylinder to compress the refrigerant.

In addition, the scroll compressor may be a compressor in which a compression space in which a working gas is sucked and discharged is formed between an orbiting scroll and a fixed scroll and the orbiting scroll rotates along the fixed scroll to compress the refrigerant.

The compressors described above include an accumulator for receiving a low-temperature and low-pressure gaseous refrigerant. The accumulator may be understood as a device for separating liquid refrigerant from the refrigerant introduced from a heat exchanger (for example, evaporator) and discharging only gaseous refrigerant to the compressor.

A structure for an accumulator of the related art is disclosed in Korean Publication No. 10-2011-0095155 as the related art. A structure in which a connection pipe extending from a side surface of the compressor is bent upward and passes through a bottom surface of the accumulator is disclosed in the related art.

In other words, a structure in which the connection pipe is formed in "L" shape to connect the compressor and the accumulator is disclosed in the related art.

However, according to the related art, since the connection pipe has to be machined to have an "L" shape to connect a side surface of the compressor and a bottom surface of the accumulator, a process is further required to bend the connection pipe into a bending pipe.

In addition, since the connection pipe of the related art is formed as a single pipe and extends to an upper side of a line vertically bisecting the accumulator after passing through the accumulator, there is a problem that vibration generated in the compressor is transferred to the accumulator through the connection pipe and as a result, a large noise is generated.

SUMMARY

The present invention has been made in order to solve the above problem and an objective of the present invention is to provide an accumulator which can minimize the transfer of vibration generated in a compressor to an accumulator side through a connection pipe.

Another objective of the present invention is to provide an accumulator that can separate a connection pipe for connecting a compressor and an accumulator and a gas-liquid separation pipe from each other.

Still another objective of the present invention is to provide an accumulator in which a connection pipe for connecting a compressor and an accumulator and a gas-liquid separation pipe can be formed as a straight pipe portion.

Still another objective of the present invention is to provide an accumulator in which materials of a connection pipe for connecting a compressor and an accumulator and the gas-liquid separation pipe can be variously selected.

According to an embodiment of the present invention, there is provided an accumulator including: a case which defines a space in which liquid refrigerant and gaseous refrigerant are accommodated; a suction pipe which is connected to one side of the case; a connection pipe which connects the other side of the case to a suction side of the compressor; and a gas-liquid separation pipe which is accommodated in the case and guides gaseous refrigerant in the case to the connection pipe. Since the gas-liquid separation pipe is disposed in the case in a state of being separated from the connection pipe, the vibration generated in the compressor can be minimally transferred to the accumulator through the connection pipe.

According to the present invention, the accumulator may further include a liquid refrigerant inflow preventing plate which is disposed in the case and supports a discharge end of the gas-liquid separation pipe. At this time, the liquid refrigerant inflow preventing plate may be horizontally disposed in the case, and the gas-liquid separation pipe may extend vertically upward from the liquid refrigerant inflow preventing plate.

According to the present invention, the liquid refrigerant inflow preventing plate includes a plate having a through-hole through which the gas-liquid separation pipe passes. In addition, the liquid refrigerant inflow preventing plate may further include an inner extension portion extending upward from an edge of the through hole. In addition, the liquid refrigerant inflow preventing plate may further include an outer extension portion extending upward from an edge of the plate. Accordingly, the gas-liquid separation pipe may be stably supported in the case.

According to the present invention, the case includes an erected cylindrical body, a top cap which covers an upper end portion of the body, and a lower cap which covers a lower end portion of the body, in which the liquid refrigerant inflow preventing plate is fixed to an inner circumferential surface or an inner circumferential surface of the body of the lower cap and thus can divide an inner space of the body and an inner space of the lower cap. Accordingly, the separated liquid refrigerant in the refrigerant can be prevented from flowing downward by the refrigerant inflow preventing plate.

According to the present invention, the connection pipe may extend horizontally and may be inserted into the case through the side surface of the lower cap.

According to the present invention, the connection pipe includes a horizontally extending horizontal portion and a bent portion which is bent at an end portion of the horizontal portion and the connection pipe may be inserted into the case through the side surface or the bottom surface of the lower cap.

According to the present invention, a suction end of the connection pipe inserted into the lower cap can be bent upward.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

In the compressor described below, as an example, a structure for a rotary compressor is disclosed. However, the accumulator of the present invention is not limited to the rotary compressor but can be applied to various compressors such as a reciprocating compressor and a scroll compressor.

Figure 1:
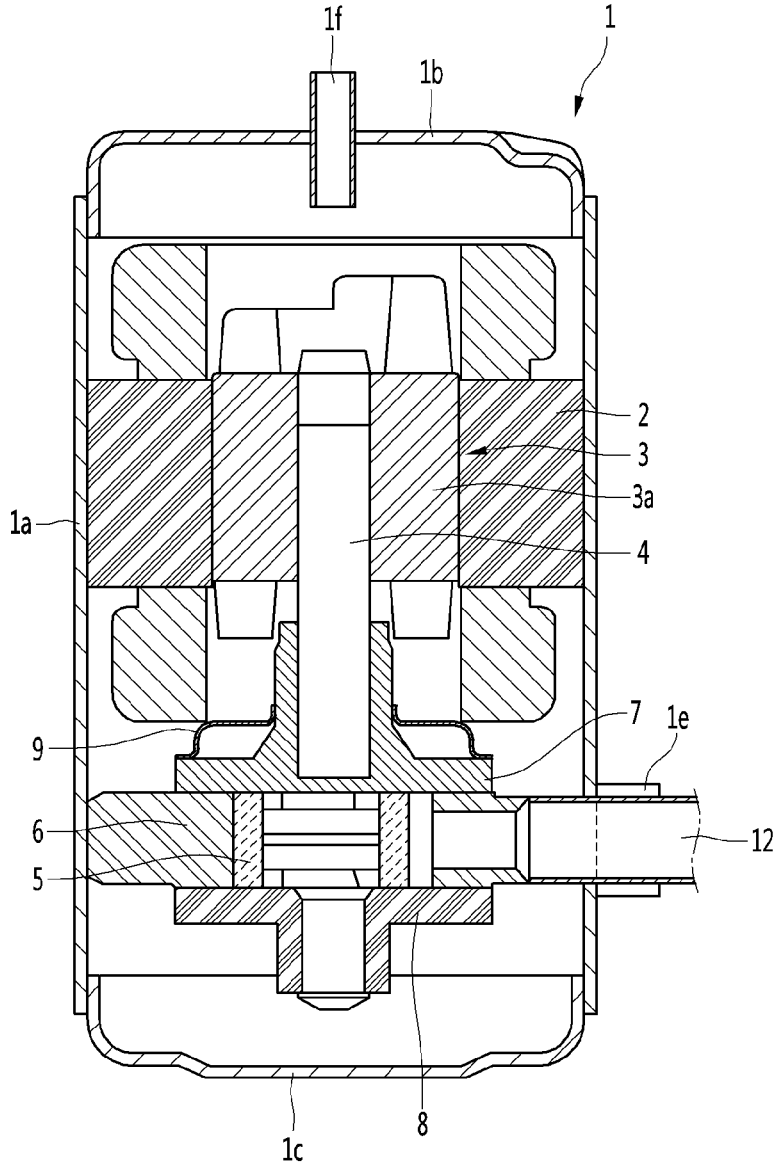
FIG. 1 is a longitudinal sectional view illustrating a configuration of a compressor according to a first embodiment of the present invention.

FIG. 1 is a longitudinal sectional view illustrating a configuration of a compressor according to a first embodiment of the present invention.

With reference to FIG. 1, the compressor 1 may be a rotary compressor.

Specifically, the compressor 1 may include a case 1*a* which forms an inner space, a top cover 1*b* which is coupled to an upper side of the case 1*a*, and a bottom cover 1*c* which is coupled to a lower side of the case 1*a*.

The case 1*a* may be formed in a cylindrical shape with an upper portion and a lower portion being opened. The case 1*a* may include a guide portion 1*e* to which the connection pipe 12 of the accumulator may be connected.

The guide portion 1*e* allows the connection pipe 12 of the accumulator to be inserted into the guide portion 1*e* so that refrigerant can be supplied to the suction portion of the compressor 1 from the accumulator.

The top cover 1*b* is coupled to cover the opened upper surface of the case 1*a*.

The top cover 1*b* may include a discharge pipe 1*f* through which the refrigerant compressed in a cylinder 6 of the compressor 1 is discharged. For example, the discharge pipe 1*f* may pass through the center of the top cover 1*b*.

A motor is provided in the case 1*a*. The motor may include a stator 2 which generates a magnetic force by an applied power and a compression mechanism portion 3 which compresses the refrigerant by an induced electromotive force generated through interaction with the stator 2.

The compression mechanism portion 3 may include a rotor 3*a* which is provided in the stator 2 and rotates. The stator 2 and the rotor 3*a* can be understood as components of the motor. The compression mechanism portion 3 may further include a rotation shaft 4 which is coupled to the rotor 3*a* and rotated according to rotation of the rotor 3*a*.

In addition, the compressor 1 may further include a roller 5 which is eccentrically coupled to a lower portion of the rotary shaft 4 and is rotated with a predetermined eccentric trajectory according to the rotation of the rotary shaft 4.

In addition, the compressor 1 may further include a cylinder 6 in which the roller 5 is accommodated.

The cylinder 6 may form a suction portion for introducing the refrigerant and a compression space for compressing the refrigerant sucked in the suction portion. The suction portion of the cylinder 6 is connected to the connection pipe 12 of the accumulator to receive the refrigerant.

In addition, the compressor 1 may further include a vane (not illustrated) for separating a suction chamber and a compression chamber from each other while reciprocating in a slot formed in the cylinder 6 according to the rotation of the roller 5.

In addition, the compressor 1 can further include a discharge portion (not illustrated) for discharging the compressed refrigerant in the compression space of the cylinder 6 and a muffler 9 which is provided on an upper portion of the discharge portion and reduces the discharge noise of the refrigerant.

The discharge portion is a passage through which the refrigerant compressed in the compression chamber is discharged when the pressure in the compression chamber of the cylinder 6 becomes the discharge pressure or more. A discharge valve for controlling discharge of the compressed refrigerant may be provided at one side of the discharge portion.

The discharge valve may be disposed on a main bearing 7 which is positioned on an upper side of the cylinder 6. Accordingly, the refrigerant discharged through the discharge portion can be introduced into the muffler 9 positioned on the upper side of the main bearing 7.

In addition, the compressor 1 may further include a main bearing 7 and a sub-bearing 8 which are provided at the upper portion and the lower portion of the cylinder 6 to support the cylinder 6.

The main bearing 7 and the sub-bearing 8 are provided in a substantial disc shape and thus can support the upper side and the lower side of the cylinder 6, respectively.

The main bearing 7 is provided on the upper side of the cylinder 6 and thus can perform a function of distributing the compression force of the refrigerant generated in the cylinder 6 or the force generated by the motor to the case 1*a* side.

In addition, the sub-bearing 8 is provided on the lower side of the cylinder 6 and thus can perform function of distributing the compressive force of the refrigerant generated in the cylinder 6 or the force generated by the motor to the case 1*a* side.

The operation according to the compressor configuration will be briefly described.

When the rotary shaft 4 is rotated, the roller 5 rotates and revolves along the inner circumferential surface of the cylinder 6 while drawing a predetermined eccentric trajectory. The refrigerant stored in the accumulator flows into the compression chamber of the cylinder 6 through the connection pipe 12 and the refrigerant is compressed in the compression chamber in a process of rotation of the roller 5.

Subsequently, when the pressure in the compression chamber becomes the discharge pressure or more, the discharge valve provided at one side of the discharge portion is opened, and the compressed refrigerant is discharged from the discharge portion through the opened discharge valve. Then, the discharged compressed refrigerant repeats a series of steps including a discharging step which is discharged through a discharge pipe 1*f* to a refrigeration cycle apparatus (not illustrated) and a suction step that is sucked back into the compression chamber of the cylinder 6 through the accumulator.

Hereinafter, the accumulator according to an embodiment of the present invention will be described in detail with reference to the drawings.

Figure 2:
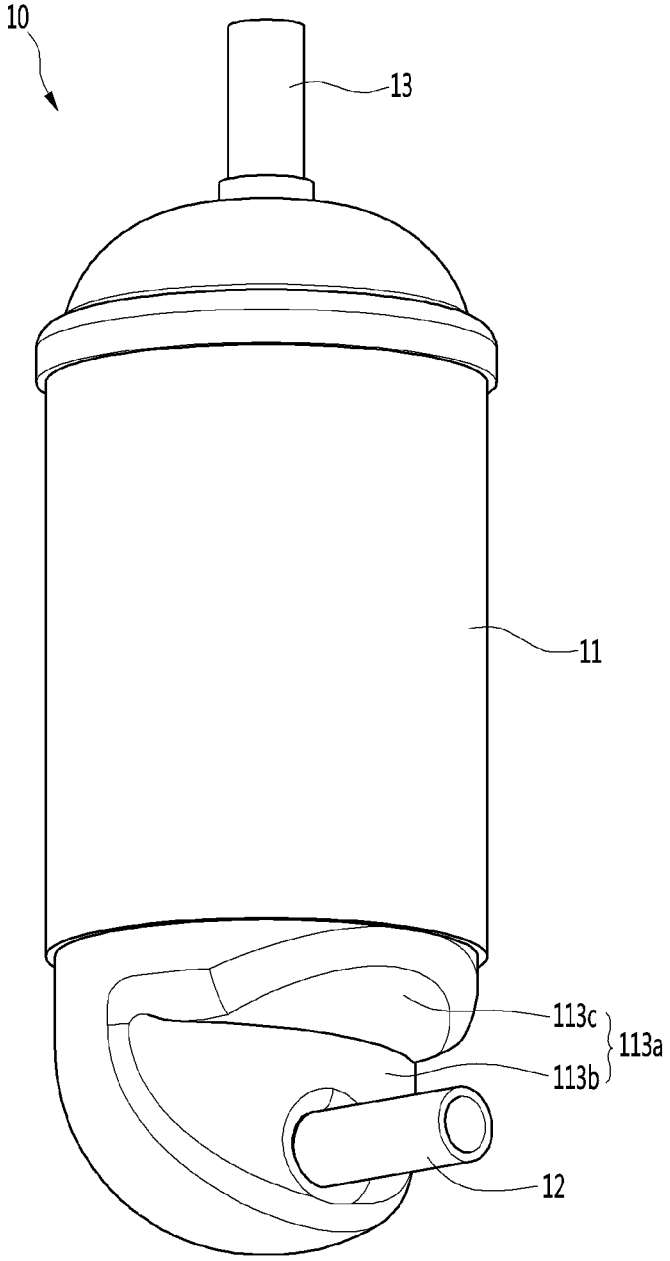
FIG. 2 is a perspective view of an accumulator according to the first embodiment of the present invention.
Figure 3:
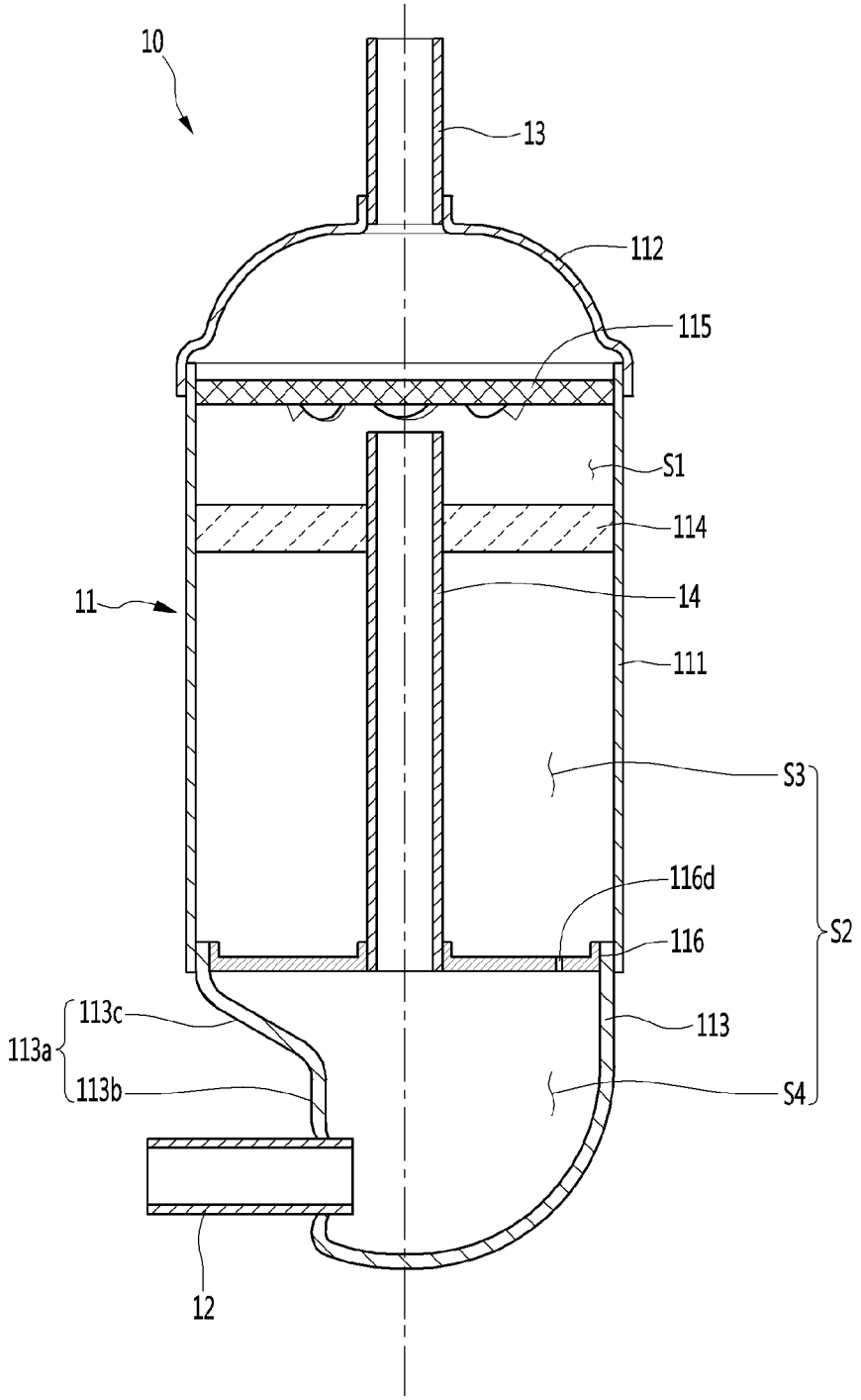
FIG. 3 is a longitudinal sectional view of the accumulator of FIG. 2.
Figure 4:
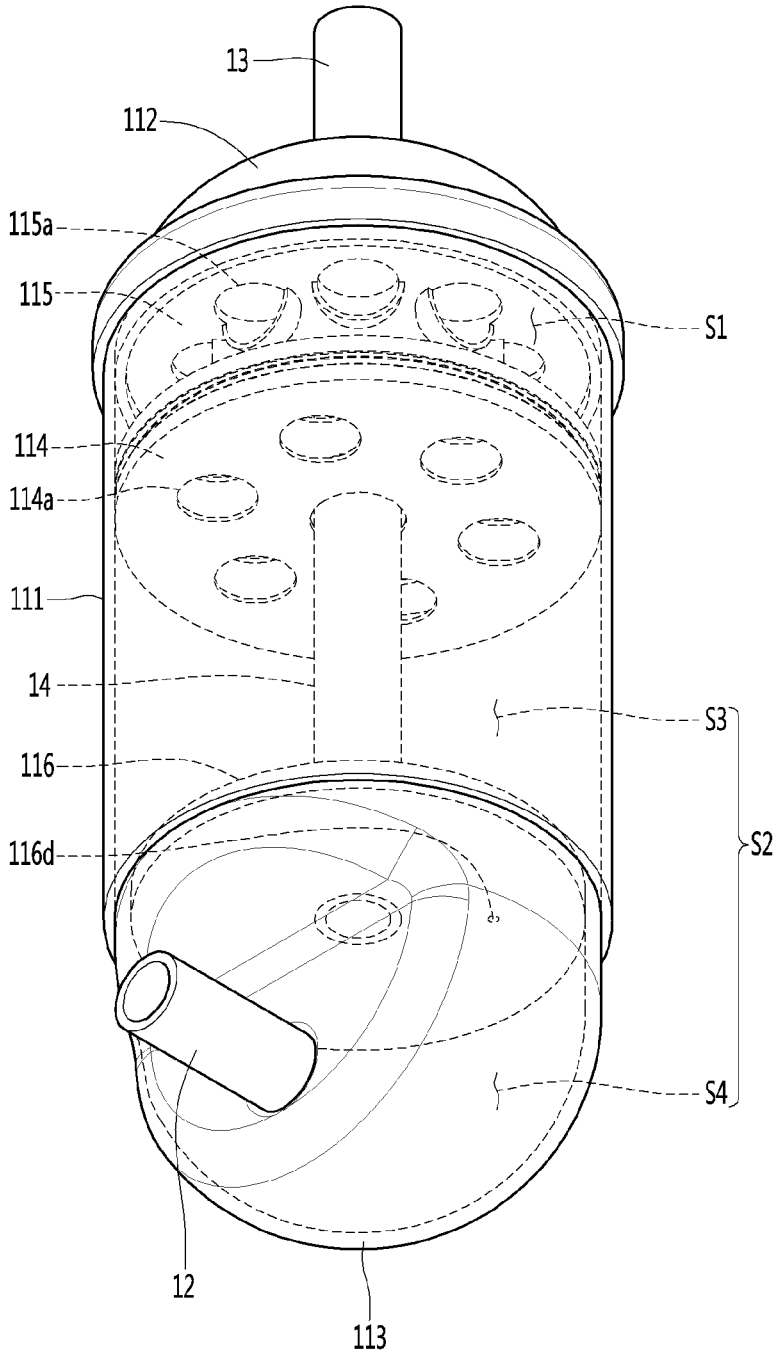
FIG. 4 is a perspective view illustrating the interior of the accumulator of FIG. 2.
Figure 5:
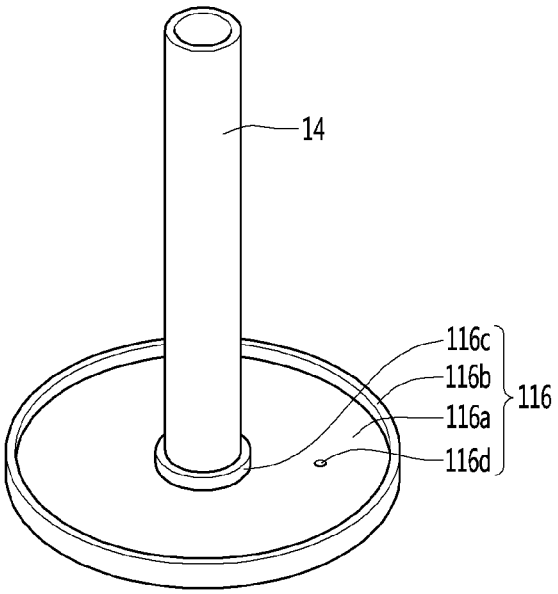
FIG. 5 is a perspective view of a liquid refrigerant inflow preventing plate coupled to the gas-liquid separation pipe according to the first embodiment of the present invention.

FIG. 2 is a perspective view of an accumulator according to the first embodiment of the present invention, FIG. 3 is a longitudinal sectional view of the accumulator of FIG. 2, FIG. 4 is a perspective view illustrating an inner portion of the accumulator of FIG. 2, and FIG. 5 is a perspective view of a liquid refrigerant inflow preventing plate coupled to a gas-liquid separation pipe according to the first embodiment of the present invention.

With reference to FIGS. 2, 3, and 4, an accumulator 10 according to an embodiment of the present invention is connected to the compressor 1 by a connecting piping 12. The accumulator 10 performs a function which separates the gaseous refrigerant in the refrigerant and supplies the separated gaseous refrigerant into the compression space of the cylinder 6. The liquid refrigerant separated through the accumulator 10 can be accommodated in the inner space of the accumulator 10.

Ideally, the refrigerant supplied to the compressor should be a low-temperature and low-pressure gaseous refrigerant. However, in reality, the low-temperature and low-pressure liquid refrigerant is partially mixed therein due to various factors. When such a liquid refrigerant flows directly into the compressor, since it may cause damage to the compressor, it is necessary to separate the liquid refrigerant from the accumulator.

Specifically, the accumulator 10 according to the present invention includes an accumulator main body 11 which forms an inner space, a connection pipe 12 which is coupled to one side of the accumulator main body 11, and a suction pipe 13 which is coupled to the other side of the accumulator main body 11.

The accumulator main body 11 includes a case.

The case provides a space in which refrigerant flows in and is separated. In other words, the liquid refrigerant and the gaseous refrigerant can be accommodated in the case. The case may be formed as a generally cylindrical shape. The inner space formed by the case may be divided into an upper space S1 and a lower space S2 by a vibration preventing plate 114 to be described below and the lower space S2 may be divided into a first space S3 and a second space S4 by the liquid refrigerant inflow preventing plate 116 to be described below.

More specifically, the case includes a body 111 of which upper portion and lower portion are opened, an upper cap 112 which is coupled to the upper side of the body 111, and a lower cap 113 which is coupled to the lower side of the body 111.

The body 111 is formed in a cylindrical shape and the upper portion and the lower portion thereof may be sealed by the upper cap 112 and the lower cap 113, respectively.

The upper cap 112 and the lower cap 113 may be hemispherical or dome-shaped. In the present embodiment, the lower cap 113 may be formed in a container shape and may be coupled to the lower side of the body 111. In addition, the gaseous refrigerant and the oil can be accommodated in the inner space of the lower cap 113.

A portion of the lower cap 113 may be recessed inward and the connection pipe 12 may be inserted into the recessed surface thereof.

Specifically, as illustrated in FIGS. 2 and 3, the lower cap 113 may include a recessed portion 113*a* which is partially recessed from the outside to the inside.

The depressed portion 113*a* may include a stepped surface 113*b*.

The stepped surface 113*b* may be formed to be spaced apart from an outer circumferential surface of the lower cap 113 by a predetermined distance in the center direction of the lower cap 113.

In addition, the recessed portion 113*a* may further include an inclined surface 113*c*.

The inclined surface 113*c* may be inclined upward from the upper end of the stepped surface 113*b* and extend in a direction away from the center of the lower cap 113. The inclined surface 113*c* may be smoothly connected to the stepped surface 113*b*.

In other words, in the present invention, by not only the stepped surface 113*b* but also an inclined surface 113*c* formed to be inclined from the upper end of the stepped surface 113*b*, the working space which can connect the connection pipe 12 to the compressor 1 can be provided.

In addition, the accumulator main body 11 may further include a screen member 115. The screen member 115 can he understood as a member for passing the gaseous refrigerant in the refrigerant sucked through the suction pipe 13 and for filtering the liquid refrigerant.

In this embodiment, the screen member 115 may be disposed on the upper portion of the body 111. Specifically, the screen member 115 is provided between the suction pipe 13 and the gas-liquid separation pipe 14 so that the foreign substances and the liquid refrigerant accommodated in the refrigerant passing through the suction pipe 13 can be filtered.

The screen member 115 may be generally formed in a disc shape and may be fixed to the inner circumferential surface of the body 111. The screen member 115 may be formed with a refrigerant through hole 115*a* for discharging the filtered liquid refrigerant to the lower side. A plurality of the refrigerant through holes 115*a* may be formed and the plurality of refrigerant through holes 115*a* may be spaced apart from each other at a predetermined gap.

In addition, the accumulator main body 11 may further include a gas-liquid separation pipe 14 for guiding the gaseous refrigerant in the case to the connection pipe 12. The gas-liquid separation pipe 14 may extend by a predetermined length in the longitudinal direction of the case. The gas-liquid separation pipe 14 can be understood as a pipe through which the filtered gaseous refrigerant through the screen member 115 passes.

In this embodiment, the gas-liquid separation pipe 14 may be formed as a straight pipe portion which is disposed below the screen member 115 and is formed to be long in the vertical direction. At this time, the gas-liquid separation pipe 14 is not connected to the connection pipe 12. Therefore, since the vibration generated in the compressor 1 is prevented from being directly transferred to the gas-liquid separation pipe 14 along the connection pipe 12, the noise due to the vibration of the connection pipe 12 can be reduced.

The gas-liquid separation pipe 14 may be vertically positioned at the center of the body 111. In other words, the central axis of the gas-liquid separation pipe 14 may coincide with the center of the body 111. In addition, the central axis of the gas-liquid separation pipe 14 may coincide with the central axis of the suction pipe 13.

In this embodiment, the discharge end of the gas-liquid separation pipe 14 may be positioned at a position spaced apart from the suction end of the connection pipe 12 by a predetermined distance upward.

In addition, the accumulator main body 11 may further include a vibration preventing plate 114. The vibration preventing plate 114 may perform a function of supporting the gas-liquid separation pipe 14 positioned in the case.

For this, the vibration preventing plate 114 may be coupled to any point of an upper portion of the gas-liquid separation pipe 14 and may be fixed to the inner circumferential surface of the case. At this time, the vibration preventing plate 114 can divide the inner space of the case into the upper space S1 and the lower space S2.

In addition, the vibration preventing plate 114 may be formed with an insertion hole for insertion into the gas-liquid separation pipe 14. Accordingly, the vibration preventing plate 114 can be fixed to the case while being inserted into the gas-liquid separation pipe 14.

In this embodiment, the vibration preventing plate 114 may be positioned below the screen member 115 and above the liquid refrigerant inflow preventing plate 116. Therefore, the liquid refrigerant filtered through the screen member 115 can fall downward and be collected on the upper surface of the vibration preventing plate 114.

The vibration preventing plate 114 may be generally formed in a disc shape, and may be fixed to the inner circumferential surface of the body 111. The vibration preventing plate 114 may be formed with a refrigerant through hole 114*a* for discharging the liquid refrigerant collected in the upper surface of the vibration preventing plate 114 downward. A plurality of the refrigerant through holes 114*a* may be formed and the plurality of refrigerant through holes 114*a* may be spaced apart from each other at a predetermined gap.

In addition, the accumulator main body 11 may further include a liquid refrigerant inflow preventing plate 116 for supporting the gas-liquid separation pipe 14. The liquid refrigerant inflow preventing plate 116 can be understood as a configuration for supporting the gas-liquid separation pipe 14 and collecting the liquid refrigerant dropped from the vibration preventing plate 114.

The liquid refrigerant inflow preventing plate 116 is disposed below the vibration preventing plate 114 and divides the lower space S2 into a first space S3 on the upper side and a second space S4 on the lower side.

Here, the first space S3 can be understood as a space in which the liquid refrigerant filtered in the refrigerant is stored, and the second space S4 can be understood as a space in which the gaseous refrigerant passing through the gas-liquid separation pipe 14 and oil are accommodated.

With reference to FIG. 5, the configuration of the liquid refrigerant inflow preventing plate 116 will be described in more detail.

With reference to FIG. 5, the liquid refrigerant inflow preventing plate 116 may be horizontally disposed in the case. The liquid refrigerant inflow preventing plate 116 may be positioned at a position spaced apart from the lower end of the case by a predetermined distance upward.

The liquid refrigerant inflow preventing plate 116 includes a plate 116*a* having a through hole (not illustrated) formed therein. In addition, the liquid refrigerant inflow preventing plate 116 may further include at least one of an outer extension portion 116*b* which extends upward along the edge of the plate 116 and an inner extension portion 116*c* which extends upwardly along the periphery of the hole.

Specifically, the plate 116*a* may be formed in a circular shape and may be coupled with the gas-liquid separation pipe 14, The plate 116*a* can divide the lower space S2 into a first space S3 and a second space S4. For this, the outer diameter of the plate 116 may be formed to be the same as the inner diameter of the lower cap 113. The outer circumferential surface of the plate 116 may be fixed to the inner circumferential surface of the lower cap 113.

At this time, as a fixing method, pressing, welding, or the like can be applied, but the present invention is not limited thereto, and a fixing method using an adhesive such as a bond or a double-sided tape can be applied.

The outer extension portion 116*b* can be understood as a component for fixing the plate 116*a* to the case. In other words, the outer extension portion 116*b* extends upward from the circumferential surface of the plate 116*a*, thereby performing a function of increasing the contact area for fixing between the plate 116*a* and the case.

In the present embodiment, the outer extension portion 116*b* is described as being fixed to the lower cap 113 of the case, but it is not limited thereto. For example, the outer extension portion 116*b* may be fixed to the inner circumferential surface of the body 111 rather than the lower cap 113 of the case.

On the other hand, at the center of the plate 116*a*, a through hole for inserting the gas-liquid separation pipe 14 may be formed. Accordingly, the plate 116*a* is fixed to the case in a state of being coupled to the gas-liquid separation pipe 14, thereby firmly supporting the gas-liquid separation pipe 14.

At an edge of the through hole, an inner extension portion 116*c* extending upward from the plate 116 may be formed. In other words, the inner extension portion 116*c* may extend by a predetermined height from the plate 116 to stably hold the periphery of the gas-liquid separation pipe 14.

In addition, the plate 116*a* may be provided with an oil recovery hole 116*d* for passing oil in the liquid refrigerant collected in the upper surface of the plate 116*a*. In other words, the oil recovery hole 116*d* can be understood as a hole for transferring the oil in the first space S3 to the second space S4.

At least one oil recovery holes 116*d* may be formed in the plate 116*a*. Therefore, the oil present on the plate 116*a* can be dropped to the lower side of the plate 116*a* through the oil recovery hole 116*d*.

The oil that is passed through the oil recovery hole 116*d* can be accommodated in the second space S4. In other words, the oil may move from the first space S3 to the second space S4, and in this process, at least a portion of the oil may be mixed with the gaseous refrigerant discharged from the gas-liquid separation pipe 14. The oil may be discharged to the connection pipe 12 together with the gaseous refrigerant.

The connection pipe 12 performs a function of a passage for providing the gaseous refrigerant or oil separated from the accumulator 10 to the compressor 1. For this, the connection pipe 12 connects one side of the accumulator 10 and one side of the compressor 1 to each other.

In the present embodiment, the connection pipe 12 can connect one side of the case and the suction side of the compressor. At this time, the connection pipe 12 may be inserted into the case through the side surface or the bottom surface of the case.

Specifically, the connection pipe 12 may be formed as a straight pipe portion extending in the horizontal direction. At this time, the connection pipe 12 is not connected to the gas-liquid separation pipe 14. Accordingly, the vibration generated in the compressor 1 is prevented from being directly transferred to the gas-liquid separation pipe 14 along the connection pipe 12. Accordingly, the noise due to the vibration of the connection pipe 12 can be reduced.

In addition, since the connection pipe 12 according to the present embodiment does not include a curved pipe, but is formed of only the straight pipe portion, there is an advantage that a bending process for forming the existing connection pipe is not required.

In the related art, a connection pipe for connecting the compressor and the accumulator is formed of a curved pipe. Therefore, a process of bending the connection pipe is further required. In addition, a connection pipe is made of a workable material, for example, a copper (Cu) material, in order to bend the connection pipe. However, since the copper material is more expensive than the steel material, the manufacturing cost is increased.

However, since the connection pipe according to the present invention is formed only by the straight pipe portion and thus the process of bending the connection pipe is not required, the connection pipe can be made of a steel material of low price and thus there is an advantage that the manufacturing cost thereof is decreased.

The connection pipe 12 may pass through a case of the accumulator 10, for example, a side surface or a bottom surface of the lower cap 113. Accordingly, a portion of the connection pipe 12 may be positioned in the lower cap 113.

The suction pipe 13 can be understood as a pipe through which a low-temperature and low-pressure refrigerant flows from a heat exchanger (for example, evaporator) not illustrated. At this time, the refrigerant flowing through the suction pipe 13 may be a mixed refrigerant in which the gaseous refrigerant and the liquid refrigerant are mixed.

The suction pipe 13 may extend from one side of the heat exchanger (not illustrated) and may be connected to the upper cap 112.

The operation according to the accumulator configuration will be briefly described.

A low-temperature and low-pressure refrigerant is sucked through the suction pipe 13 from the heat exchanger (for example, evaporator) not illustrated. The refrigerant sucked through the suction pipe 13 passes through the screen member 115 and foreign matter and liquid refrigerant are filtered therefrom.

The gaseous refrigerant in the refrigerant passes through the screen member 115 and then is moved to the second space S4 formed by the lower cap 113 through the gas-liquid separation pipe 14.

The liquid refrigerant filtered by the screen member 115 drops down through the refrigerant through hole 115*a* formed in the screen member 115 and is collected in the vibration preventing plate 114. The liquid refrigerant collected in the vibration preventing plate 114 drops through the liquid refrigerant through hole 114*a* formed in the vibration preventing plate 114 and is collected in the liquid refrigerant inflow preventing plate 116.

The liquid refrigerant dropped into the upper surface of the liquid refrigerant inflow preventing plate 116 is lifted while being vaporized by the surrounding heat and is moved to the second space S4 through the gas-liquid separation pipe 14.

On the other hand, the gaseous refrigerant flowing into the second space S4 is sucked into the suction portion of the cylinder 6 through the connection pipe 12. At this time, the oil dropped into the second space S4 through the oil recovery hole 116*d* is mixed with the gaseous refrigerant flowing through the second space S4 and is discharged along with the gaseous refrigerant through the connection pipe 12.

Figure 6:
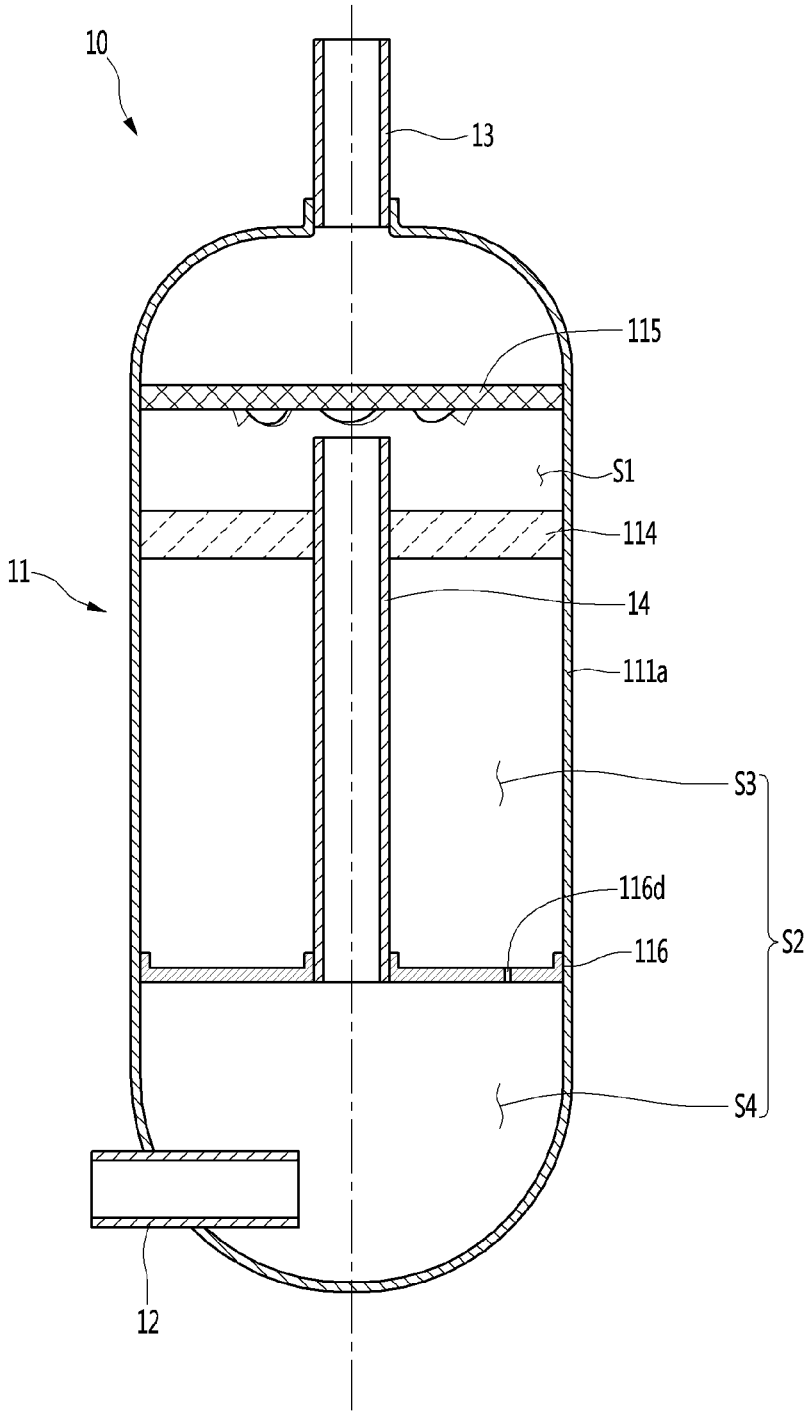
FIG. 6 is a longitudinal sectional view of an accumulator according to a second embodiment of the present invention.

FIG. 6 is a longitudinal sectional view of an accumulator according to a second embodiment of the present invention.

The present embodiment is the same as the first embodiment in other portions and is characterized in that there is a difference only in the shape of the case. Accordingly, only characteristic portions of the present embodiment will be described below and the same portions as those of the first embodiment will be referred to those.

With reference to FIG. 6, the accumulator 10 according to the second embodiment of the present invention includes an accumulator main body 11 which forms an inner space, a suction pipe 13 which is coupled to one side of the accumulator main body 11, and a connection pipe 12 which connects the other side of the accumulator main body 11 and the suction side of the compressor 1.

In the present embodiment, the accumulator main body 11 includes a case 111*a* which forms a space in which liquid refrigerant and gaseous refrigerant are accommodated. The case 111*a* may be formed in a cylindrical shape. As an example, the case 111*a* may be integrally formed and may have an erected cylindrical shape.

In addition, the connection pipe 12 may be inserted into a side surface of the case 111*a*. In other words, the connection pipe 12 may be inserted into the case 111*a* through the side surface of the case 111*a*.

The connection pipe 12 may be formed horizontally. The suction end of the connection pipe 12 may be positioned below the discharge end of the gas-liquid separation pipe 14 positioned in the case 111*a*.

Figure 7:
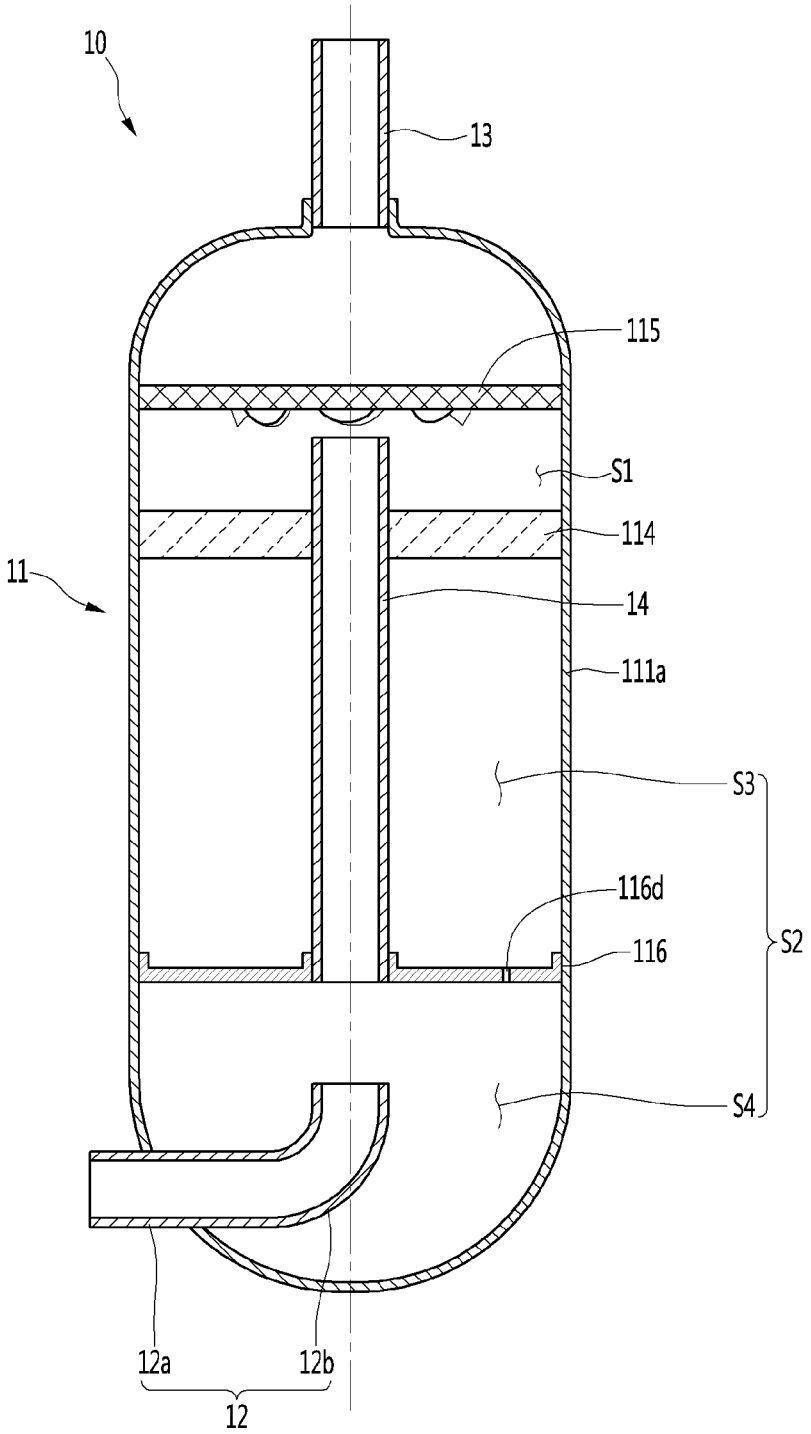
FIG. 7 is a longitudinal sectional view of an accumulator according to a third embodiment of the present invention.

FIG. 7 is a longitudinal sectional view of an accumulator according to a third embodiment of the present invention. The present embodiment is the same as the second embodiment in the other portions and is characterized in that there is a difference only in the shape of the connection pipe. Accordingly, only characteristic portions of the present embodiment will be described below and the same portions as those of the second embodiment will be referred to those.

With reference to FIG. 7, the accumulator 10 according to a third embodiment of the present invention includes an accumulator main body 11 which forms an inner space, a suction pipe 13 which is coupled to one side of the accumulator main body 11, and a connection pipe 12 which connects the other side of the accumulator main body 11 and the suction side of the compressor 1.

In the present embodiment, the accumulator main body 11 includes a case 111*a* which forms a space in which liquid refrigerant and gaseous refrigerant are accommodated. The case 111*a* may he formed in a cylindrical shape. As an example, the case 111*a* may be integrally formed and may have an erected cylindrical shape.

In addition, the connection pipe 12 may be inserted into a side surface of the case 111*a*. In other words, the connection pipe 12 may be inserted into the case 111*a* through the side surface of the case 111*a*.

The connection pipe 12 includes a horizontally extending horizontal portion 12*a* and a bent portion 12*b* which is bent at an end portion of the horizontal portion 12*a*.

The horizontal portion 12*a* may extend horizontally and pass through a side surface of the case 111*a* and then be positioned in the case 111*a*. The bent portion 12*b* may be bent at the end portion of the horizontal portion 12*a* positioned in the case 111*a*.

In the present embodiment, the bent portion 12*b* may extend upward from an end portion of the horizontal portion 12*a*. At this time, the bent portion 12*b* may be disposed to face the gas-liquid separation pipe 14. In addition, the vertical central axis of the bent portion 12*b* may coincide with the vertical central axis of the gas-liquid separation pipe 14.

Figure 8:
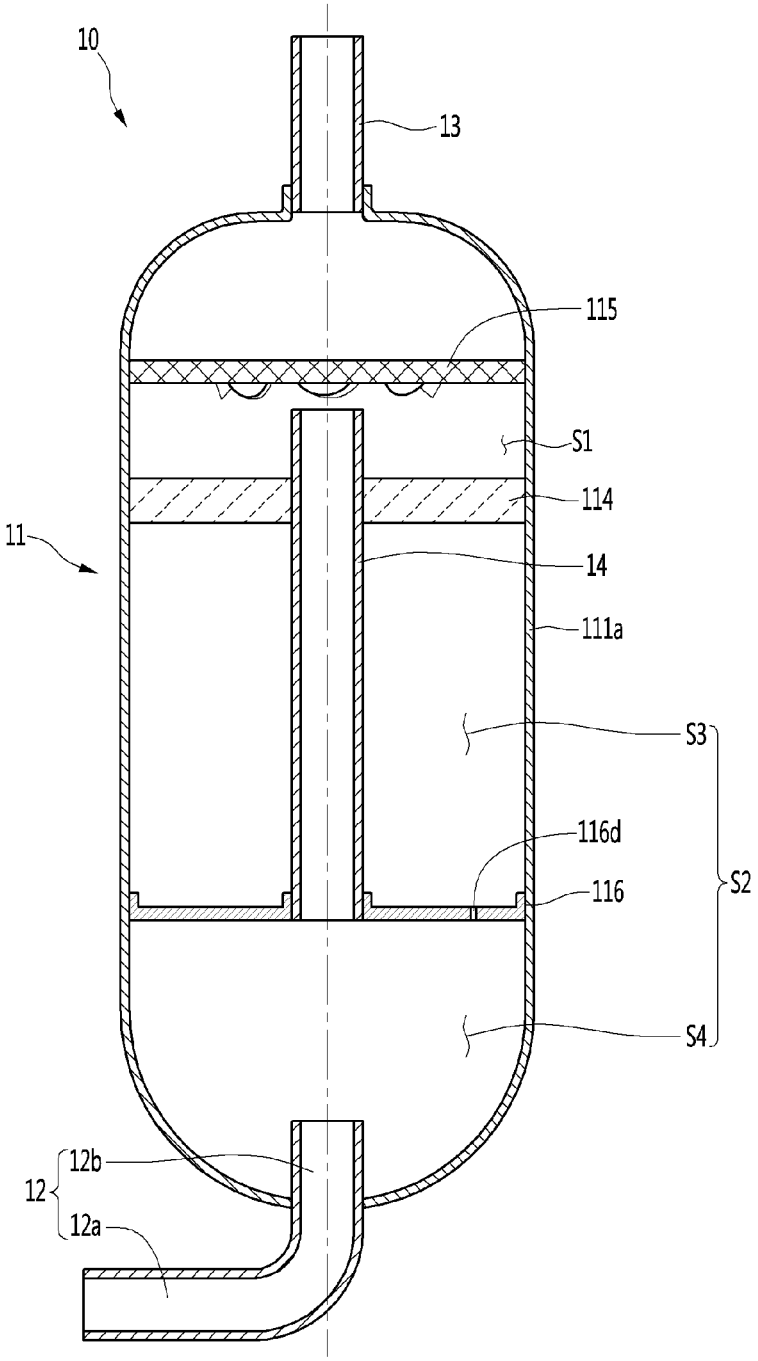
FIG. 8 is a longitudinal sectional view of an accumulator according to a fourth embodiment of the present invention.

FIG. 8 is a longitudinal sectional view of an accumulator according to a fourth embodiment of the present invention.

The present embodiment is the same as the second embodiment in other portions and is characterized in that there is a difference only in the shape of the case. Accordingly, only characteristic portions of the present embodiment will be described below and the same portions as those of the second embodiment will be referred to those.

With reference to FIG. 8, the accumulator 10 according to the fourth embodiment of the present invention includes an accumulator main body 11 which forms an inner space, a suction pipe 13 which is coupled to one side of the accumulator main body 11, and a connection pipe 12 which connects the other side of the accumulator main body 11 and the suction side of the compressor 1.

In the present embodiment, the accumulator main body 11 includes a case 111*a* which forms a space in which liquid refrigerant and gaseous refrigerant are accommodated. The case 111*a* may be formed in a cylindrical shape. As an example, the case 111*a* may be integrally formed and may have an erected cylindrical shape.

In addition, the connection pipe 12 may be inserted into the bottom surface of the case 111*a*. In other words, the connection pipe 12 may be inserted into the case 111*a* through the bottom. surface of the case 111*a*.

The connection pipe 12 includes a horizontally extending horizontal portion 12*a* and a bent portion 12*b* which is bent at an end portion of the horizontal portion 12*a*.

The horizontal portion 12*a* horizontally extends from the lower side of the case 111*a*. The bent portion 12*b* may be bent at the end portion of the horizontal portion 12*a* and pass through the bottom surface of the case 111*a*.

In other words, the connection pipe 12 according to the present embodiment is horizontally extended from the lower side of the case 111*a* and then the end portion thereof is bent upwardly and inserted through the bottom surface of the case 111*a*. At this time, the bent portion 12*b* of the connection pipe 12 may be disposed to face the gas-liquid separation pipe 14. In addition, the vertical central axis of the bent portion 12*b* may coincide with the vertical central axis of the gas-liquid separation pipe 14.

According to various embodiments of the present invention described above, since the connection pipe connecting the compressor and the accumulator and the gas-liquid separation pipe are separated from each other, it is possible to minimize transfer of the vibration generated from the compressor to the accumulator through the connection pipe. Accordingly, since the vibration of the accumulator by the vibration generated in the compressor is minimized, noise due to the vibration can be greatly reduced.

In addition, since both the connection pipe connecting the compressor and the accumulator and the gas-liquid separation pipe can be formed as straight pipe portions, the process of machining the connection pipe into the bending pipe can be omitted. In addition, since the process of bending the connection pipe and the gas-liquid separation pipe can be omitted, it is possible to widely select a range of materials to be applied to the pipe, and accordingly, there is an advantage of decreasing manufacturing prices by adopting pipe made of low-cost material.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An accumulator that is connectable to a compressor, comprising:

a case to hold a liquid refrigerant and a gaseous refrigerant;

a suction pipe provided at a first side of the case;

a connection pipe for connecting a second side of the case to a suction side of the compressor; and a gas-liquid separation pipe provided inside the case to guide the gaseous refrigerant to the connection pipe, and wherein the gas-liquid separation pipe is separate from the connection pipe, and wherein a discharge end of the gas-liquid separation pipe is spaced apart from the suction end of the connection pipe by a predetermined distance in an upward direction.

2. The accumulator of claim 1, wherein the gas-liquid separation pipe extends a predetermined length in the longitudinal direction of the case.

3. The accumulator of claim 2, wherein a central axis of the gas-liquid separation pipe and a central axis of the case overlap with each other.

4. The accumulator of claim 3, wherein a central axis of the suction pipe and a central axis of the gas-liquid separation pipe overlap with each other.

5. The accumulator of claim 1, further comprising:

a liquid refrigerant inflow preventing plate that is provided inside the case to support the discharge end of the gas-liquid separation pipe.

6. The accumulator of claim 5, wherein the liquid refrigerant inflow preventing plate is horizontally disposed inside the case, and wherein the gas-liquid separation pipe extends upwardly from the liquid refrigerant inflow preventing plate.

7. The accumulator of claim 6, wherein an oil recovery hole is formed at a side of the liquid refrigerant inflow preventing plate.

8. The accumulator of claim 6, wherein the liquid refrigerant inflow preventing plate is spaced apart from a lower end portion of the case by a predetermined distance in an upward direction.

9. The accumulator of claim 5, wherein the liquid refrigerant inflow preventing plate separates an inner cavity of the case into a first cavity and a second cavity, the first cavity being located above the second cavity.

10. The accumulator of claim 9, wherein the liquid refrigerant inflow preventing plate comprises a plate having a through hole through which the gas-liquid separation pipe passes.

11. The accumulator of claim 10, wherein the plate comprises an oil recovery hole through which oil in the first cavity may be received into the second cavity.

12. The accumulator of claim 10, wherein the liquid refrigerant inflow preventing plate further comprises an inner extension portion that extends upwardly from an outer edge of the through hole and surrounds a portion of the gas-liquid separation pipe.

13. The accumulator of claim 10, wherein the liquid refrigerant inflow preventing plate further comprises an outer extension portion that extends upwardly from an outer edge of the plate, and wherein an outer circumferential surface of the outer extension portion is attached to an inner circumferential surface of the case.

14. The accumulator of claim 5, wherein the case comprises:

a cylindrical body;

an upper cap that covers an upper end portion of the body; and a lower cap that covers a lower end portion of the body, and wherein the liquid refrigerant inflow preventing plate is attached to an inner circumferential surface of the body or an inner circumferential surface of the lower cap, the liquid refrigerant inflow preventing plate disposed to separate an inner cavity of the body and an inner cavity of the lower cap.

15. The accumulator of claim 14, wherein the connection pipe extends horizontally and extends inside the case through a side surface of the lower cap.

16. The accumulator of claim 14, wherein the connection pipe comprises:

a horizontal portion that extends horizontally; and a bent portion that is bent at an end portion of the horizontal portion, and wherein the connection pipe extends inside the case through a side surface of the lower cap or through a bottom surface of the lower cap.

17. The accumulator of claim 16, wherein the suction end of the connection pipe that extends inside the lower cap is bent in an upward direction.

18. The accumulator of claim 1, further comprising:

a screen member disposed between the suction pipe and the gas-liquid separation pipe to separate the liquid refrigerant from the gaseous refrigerant.

19. The accumulator of claim 5, further comprising:

a vibration preventing plate disposed above the liquid refrigerant inflow preventing plate, wherein the vibration preventing plate supports the gas-liquid separation pipe.

20. An accumulator that is connectable to a compressor, comprising:

a case to hold a liquid refrigerant and a gaseous refrigerant;

a suction pipe provided at a first side of the case;

a connection pipe for connecting a second side of the case to a suction side of the compressor;

a gas-liquid separation pipe provided inside the case to guide the gaseous refrigerant to the connection pipe; and a liquid refrigerant inflow preventing plate provided inside the case to support the discharge end of the gas-liquid separation pipe, wherein the gas-liquid separation pipe is separate from the connection pipe, and wherein an oil recovery hole is formed at a side of the liquid refrigerant inflow preventing plate.

* * * * *